US009354613B2

(12) United States Patent
Serber

(10) Patent No.: US 9,354,613 B2
(45) Date of Patent: May 31, 2016

(54) PROPORTIONAL HOUR TIME DISPLAY

(71) Applicant: Rajendra Serber, Oakland, CA (US)

(72) Inventor: Rajendra Serber, Oakland, CA (US)

(73) Assignee: Rajendra Serber, Oakland, CA (US)

( * ) Notice: Subject to any disclaimer, the term of this patent is extended or adjusted under 35 U.S.C. 154(b) by 0 days.

(21) Appl. No.: 14/266,815

(22) Filed: Apr. 30, 2014

(65) Prior Publication Data

US 2014/0328151 A1 Nov. 6, 2014

Related U.S. Application Data

(60) Provisional application No. 61/818,415, filed on May 1, 2013, provisional application No. 61/819,236, filed on May 3, 2013.

(51) Int. Cl.

| | |
|---|---|
| ***G04G 9/02*** | (2006.01) |
| ***G04G 9/08*** | (2006.01) |
| ***G04G 9/00*** | (2006.01) |

(52) U.S. Cl.

CPC ..... *G04G 9/0082* (2013.01); *G04G 9/00* (2013.01); *G04G 9/02* (2013.01)

(58) Field of Classification Search

CPC ..... G04G 9/02; G04G 9/08; G04G 9/0082; G04G 9/00

See application file for complete search history.

(56) References Cited

U.S. PATENT DOCUMENTS

| | | | | |
|---|---|---|---|---|
| 4,659,232 | A * | 4/1987 | Coster et al. | 368/223 |
| 5,748,568 | A * | 5/1998 | Harrison | 368/82 |
| 6,584,041 | B1 * | 6/2003 | Terzian et al. | 368/82 |
| 6,693,606 | B1 * | 2/2004 | Shitisawa et al. | 345/33 |
| 2003/0193842 | A1 * | 10/2003 | Harrison | G04B 25/00 368/82 |
| 2005/0041536 | A1 * | 2/2005 | Lang | 368/223 |
| 2006/0209638 | A1 * | 9/2006 | Harrison, Jr. | G04B 25/00 368/223 |
| 2007/0147181 | A1 * | 6/2007 | Piccirillo | 368/223 |
| 2008/0175106 | A1 * | 7/2008 | Vikesland | 368/83 |
| 2012/0113766 | A1 * | 5/2012 | Comeau | 368/239 |
| 2013/0039156 | A1 * | 2/2013 | Lin | 368/228 |

* cited by examiner

*Primary Examiner* — Amy Cohen Johnson
*Assistant Examiner* — Matthew Powell

(57) ABSTRACT

The invention is a method and system for graphical representation of time. In this invention the hours are represented by an hour symbol drawn in a display area. The minutes of the hour are represented by a translation attribute of the hour symbol, which changes the hour symbol proportionally as the minutes of the hour lapse. The translation attribute may be position, size, rotation, a combination or other attributes. In a preferred embodiment, the visual identification of the minute is enhanced by the addition of a proportional change in the state of the background to indicate the minutes past the hour.

24 Claims, 3 Drawing Sheets

PROPORTIONAL HOUR TIME DISPLAY

RELATED APPLICATIONS

This application claims the benefit of U.S. Provisional Patent Application Nos. 61/818,415 entitled PROPORTIONAL HOUR CLOCK DISPLAY filed May, 1 2013; and 61/819,236 entitled DIGITAL-ANALOG HYBRID CLOCK FOR ELECTRONIC DISPLAY filed May, 3 2013.

TECHNICAL FIELD

The disclosed embodiments relate generally to the graphical representation of time, and more particularly to a graphical representation of time on devices such as smart-watches, smartphones, desktop computers, clocks, watches and other devices.

BACKGROUND

Commonly time is referred to in a relative manner to the hour; Time is usually spoken of in fifteen minute increments relative to the hour that has past or is approaching. For instance, if somebody asks what time it is when it is 9:16 most people will say "quarter past nine," or at 1:42 most people will say "a quarter to two." The vast majority of appointments are schedule at the beginning of the hour and to a lesser degree the half hour, even less common would be 15 minutes past or a quarter to the hour. A clock that highlights these 15 minute increments would better represent how we talk about time and would be enough precision for common use.

The conventional modes of representing time is either circular analog or digital numbers. A circular analog clock is known to tell time with two "hands" moving in a circle indicating the hour and minute by pointing at increment markers that are arranged in a circle in a round clock face. A digital clock is known to represent the time showing only numeric digits in a fixed position with the hours and minutes numbers separated by a colon. A third method of telling time, which is less common, is a linear clock, which has two "hands" which move across a linear row of increment markers.

Digital clocks have the benefit of precision but they lack a visually identifiable relative representation of time. They represent a level of detail that does not represent the relative manner in which time is spoken of.

Circular and linear analog clocks do represent time in relative manner. But having two or three hands that move along the same path is ambiguous and not instantly identifiable. The operator has to decipher which hand is for hours, which for minutes and which is for seconds. Even when one has extensively practiced reading this type of clock it still takes time to detect the difference between the two, or three similar hands. Adding to the clutter standard circular and linear analog clocks show numbers for 12 hours even when the reader only needs to see the current hour.

These designs became prominent as the best solution within the technological limitations of the time. Circular analog clocks are a good solution for mechanical technology, and digital clocks are a good solution for the limitation of early LED and LCD technology. Current display technology is liberated from the previous limitation of mechanical, LED and LCD technology. Yet the vast majority of time representations on computer controlled screens still only represents time with two rotating hands or four numbers in a fixed position.

Accordingly, there is a need for a graphic time representation that simplifies the representation of time and represents time in an instantly visually identifiable manner.

SUMMARY

The above deficiencies and other problems associated with conventional modes of representing time are reduced or eliminated by the disclosed representation of time. An objective of the invention is to provide a graphic clock display that simplifies the representation of time, and represents time in an instantly visually identifiable manner. Focusing on the relative nature of time telling this invention removes the need for extraneous numbers and markers when only a relative understanding of the current time needed. By paring down the markings this invention makes the approximate time instantly visually identifiable.

Additional markers with a fine hour division may be separately displayed such that time can be exactly identified without impairing the instant identification of the coarse hour divisions. By further making a graphic differentiation of the hour, the minute and the second this invention also improves the visual identification of the exact minutes and seconds. This invention allows for fast and intuitive interpretation of the represented time particularly on low contrast and/or monochrome displays.

The invention is a method and system for graphical representation of time that indicates the current time preferably in a continuous fashion preferably by use of a processing system controlled display screen. In this invention the hours are represented by an hour symbol which is a preferably numeric symbol. The minutes of the hour are represented by a translation attribute of the hour symbol, which changes proportionally as the minutes of the hour lapse.

The display area defines the boundary of the clock within a display. The display area may be the full display or a subset of a the full display screen. The display area can be any shape. The hour symbol can be any numeric writing system or other devised representation of the specific hour of the day. The translation attribute of the hour symbol is relative to the display area; The translation attribute of the hour symbol may be the position (FIGS. 1A-1D), size (FIGS. 2A-2D), or rotation (FIGS. 4A-4D), a combination of these attributes (FIGS. 3A-3C), or other attributes.

In a preferred embodiment, the visual identification of the relative time between full hours is enhanced by the addition of a proportional change in the state of the background to indicate the minutes past the hour FIGS. 2A-3C, 5A-7C. The background of the display area becomes divided proportionally with the first area for the proportion of minutes remaining in the hour, and the second area for the proportion of minutes past the hour. The intersection of these two states may mark the current minute. The state of the two areas can be differentiated by distinct colors (FIGS. 2A-3C, 5A-7C), patterns, images, animations or other data.

The visual identification of the specific minute may be further enhanced by the addition of minute increment markers FIGS. 5A-8, which may be toggled on and off. Markings are arranged to easily identify the 15 minute increments which are referred to in common terms for time. Markers are highlighted at 15, 30, and 45 minutes past the hour. Markers can be automatically hidden on the hour to highlight that the current time is zero minutes past the hour.

In another embodiment a seconds indicator can optionally be toggled on or off. The seconds indicator is preferably updated continuously with a seconds symbol that represents the exact second. The seconds symbol may be an abstract symbol that moves along the minute increment markers FIG. 5A 51, a numeric symbol that moves along the minute increment markers, or a symbol at a fixed position which is a numeric symbol or proportional animation FIG. 6C 51.

This invention can be on any size device such as wristwatch, mobile phone, desktop computer, wall clock or tower clock. The display area and hours symbol, minute increment markers and seconds symbols can be distinguishing elements such as shape, size, color, patterns, images, animations or data according to the features and limitations of the one or more display screens available to the device. If the device can access a network the distinguishing elements can be retrieved from another device. The high contrast illustrations in the figures are especially suited to monochrome display screens such as passive-matrix LCD or E Ink.

Examples are set forth in the accompanying drawings and the description below. Other features, objects, and advantages will be apparent from the description and drawings, and from the claims. Other aspects of the invention provide methods, systems, program products, and methods of using and generating each, which include and/or implement some or all of the actions described herein. The illustrative aspects of the invention are designed to solve one or more of the problems herein described and/or one or more other problems not discussed.

These and other features of the disclosure will be more readily understood from the following detailed description of the various aspects of the invention taken in conjunction with the accompanying drawings that depict various aspects of the invention. The drawings are intended to depict only typical aspects of some possible embodiments of the invention, and therefore should not be considered as limiting the scope of the invention.

DESCRIPTION OF EMBODIMENTS

Embodiments of the present invention are directed to a graphical representation of time, examples of which are illustrated in the accompanying drawings. In the following detailed description numerous specific details are set forth in order to provide a thorough understanding of the present invention. However, it will be apparent to one of ordinary skill in the art that the present invention may be practiced without these specific details.

In order to avoid unnecessarily obscuring aspects of the embodiments this presentation of this invention does not described in detail many well-known methods, procedures, components, storage mediums, display technology, sensors, or circuits. Functions such as setting the time, toggling optional elements on and off, and other user input can be accomplishes with a plurality of well-known components, the specifics of which is also avoided in order to not distract from the useful, novel and non-obvious aspects of this invention.

The methods and systems described herein may be implemented on many different types of processing devices by program code comprising program instructions that are executable by one or more processors. The software program instructions may include source code, object code, machine code, or any other stored data that is operable to cause a processing system to perform methods described herein.

In some implementations of the disclosed technology, a computing device may output a graphical representation of time for display at a one or more display screens. The device may be, for example, a wristwatch, mobile phone, digital media player, general purpose computer systems, special purpose computer systems, an embedded device within another device, digital signage, wall clock, or tower clock. The device may, in at least certain embodiments, include a display screen which is coupled to the processing system to display a graphical representation of time. In some embodiments, the device and display screen are integrated while in other embodiments the device and one or more display screens are separate devices. The display area of this invention can be any shape which may be fully filling the display screen, or may be a smaller defined display area within the display screen or may span a plurality of display screens.

Figure 9:
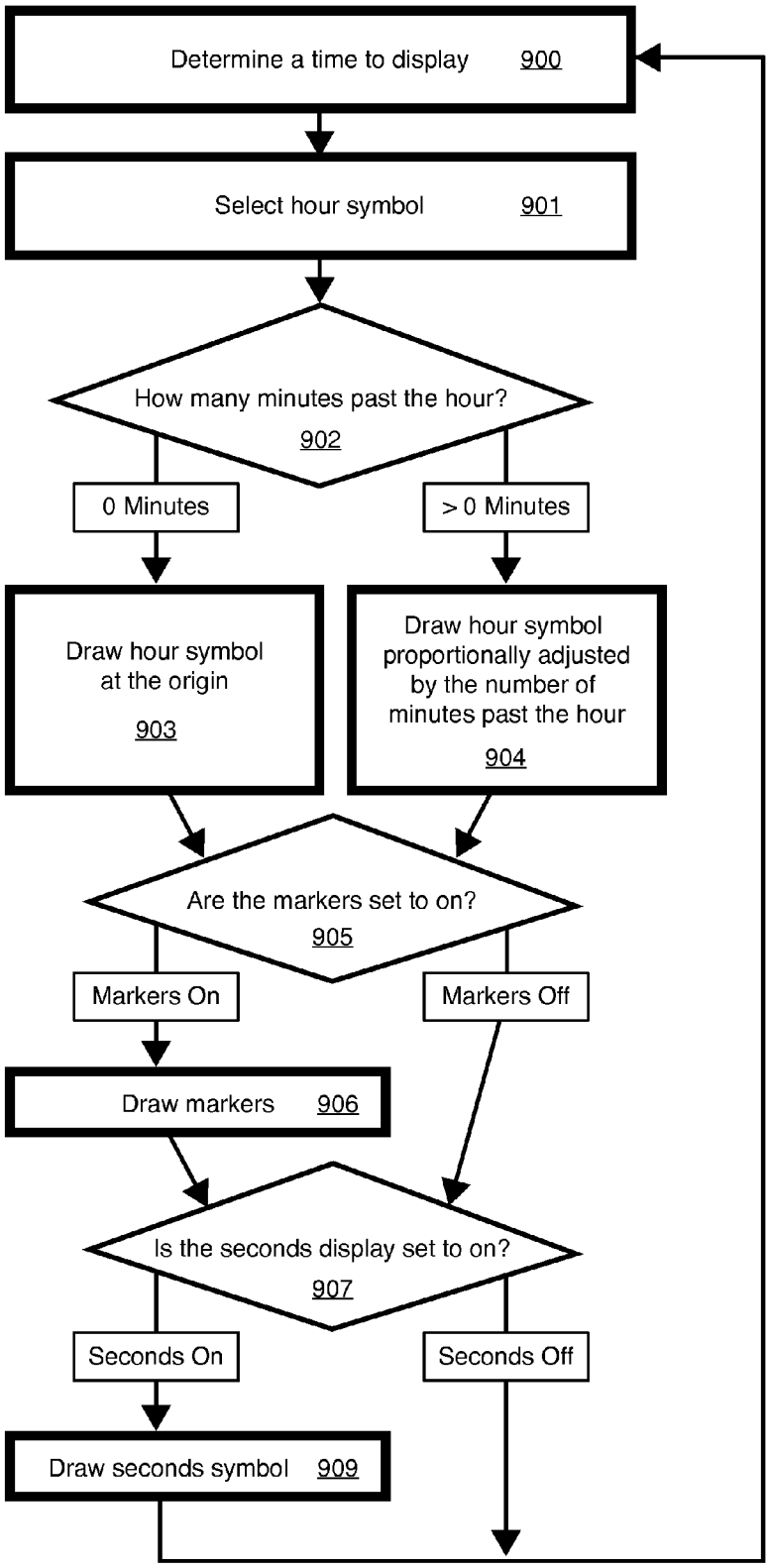
FIG. 9 is a flow diagram illustrating a process of proportionally adjusting the hour displayed implementing an exemplary embodiment.

An exemplary embodiment of the invention can be structured according to this basic event loop presented in FIG. 9. Starting with determining a time to display 900 by either getting the current time, or receiving an arbitrary time. Arbitrary times may be sent for a variety of reasons, including: using the invention as an interface to set the time, or when using it as an interface for a count down timer, or stopwatch. Once the time is retrieved the process next selects the hour symbol to display based on the time to display 901. The hour symbol may come from any well known numeric writing system or other devised representation of the specific hour of the day. Next the process determines the minute from the time to display 902. If the time is zero minutes past the hour, the hour symbol will be drawn fully at the origin in the display area 903. If there are more than zero minutes past the hour, the hour symbol is proportionally adjusted between the origin and the destination based on the number of minutes in the time to display, the translation attribute, and the display area. Then the proportionally adjusted hour symbol is drawn in the display area 904. Depending on the selected implementation the translation attribute may be a specific position in the display area, a specific size, a specific rotation, a combination of these attributes, or other attributes. Some exemplary translation attributes are illustrated by FIGS. 1A-4D and described in more detail below.

Figure 1A:
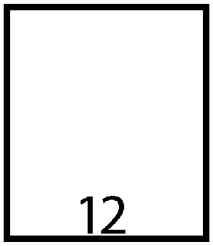
FIGS. 1A-1D are time-lapsed illustrations of a first implementations of the invention.
Figure 1B:
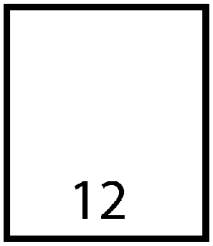
Figure 1C:
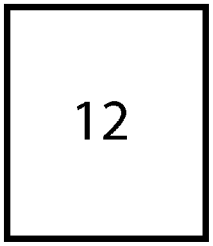
Figure 1D:
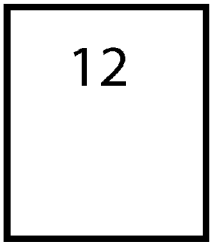
Figure 2A:
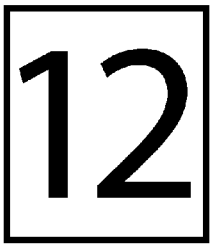
FIGS. 2A-2D are time-lapsed illustrations of a second implementations of the invention.
Figure 2B:
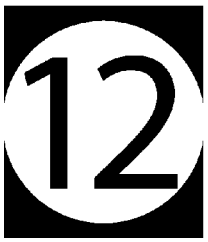
Figure 2C:
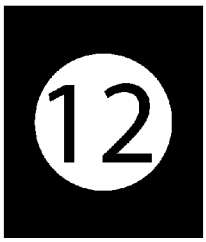
Figure 2D:
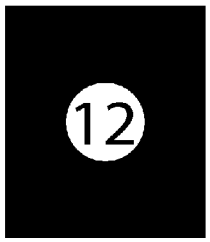
Figure 3A:
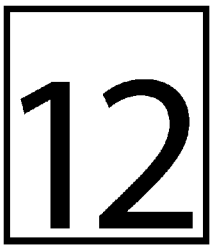
FIGS. 3A-3D are time-lapsed illustrations of a third implementations of the invention.
Figure 3B:
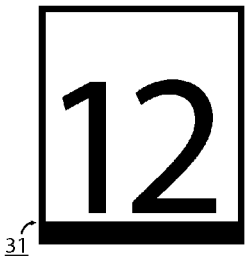
Figure 3C:
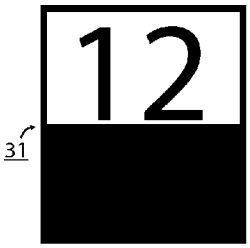
Figure 3D:
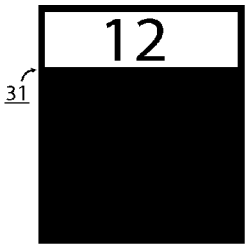
Figure 4A:
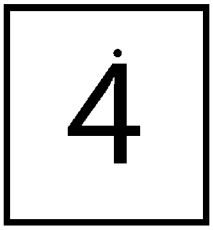
FIGS. 4A-4D are time-lapsed illustrations of a forth implementations of the invention.
Figure 4B:
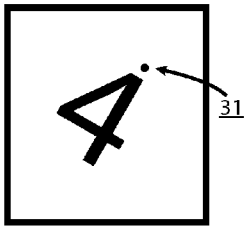
Figure 4C:
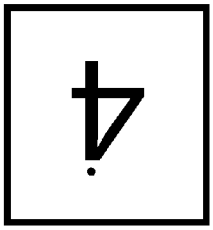
Figure 4D:
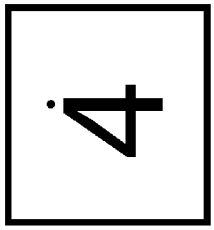
Figure 5A:
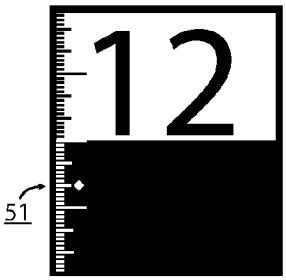
FIGS. 5A-5B show an implementations of minute increment markers at an interval of 1 marker for every minute.

In addition to the basic event loop FIG. 9 illustrates the logic of additional elements of an exemplary embodiment of the invention. Minute increment markers to aid in reading the exact minute may be shown 906 when a user sets the markers to be on 905. Some potential minute increment markers are illustrated in FIGS. 5A, 7C and 8 and described in more detail below. A seconds symbol may be displayed 908 if the user has set the seconds setting on 907. Two potential seconds symbols are illustrated in FIGS. 5A 51 and 6C 51 and described in more detail below.

In a first implementation of the invention the translation attribute is the position of the hour symbol; the position in the display area indicates the proportion of minutes of the hour of the time to display which have past. The placement of the hour symbol is on a path in a proportional position between an origin and destination point in the display area. The hour symbol's movement along the path from the origin point to the destination point in the display area can be in any orientation: vertical, horizontal or any other degree.

FIGS. 1A-1D are time-lapsed illustrations of 4 times that demonstrate a first implementation. In these examples: the display area shape is rectangular, the origin point is at the bottom of the display area, the destination point is at the top of the display area, the times indicated by the position of the hour symbol in these figures are 1A twelve o'clock (12:00), 1B five minutes past twelve (12:05), 1C twelve thirty (12:30), 1D twelve forty-five (12:45).

In a preferred embodiment, the discernment of the relative time between full hours is enhanced by the addition of a proportional change in the state of the background in conjunction with the proportional adjustment of the number of minutes of the time to display. Various example of this are shown in FIGS. 2A-3C, 5A-7C). The display area is divided proportionally into a first state to represent the remaining minutes of the hour, and a second state to represent the past minutes of the hour. The state of the two areas can be differentiated by distinct colors as demonstrated in FIGS. 2A-3C, 5A-7C, or patterns, images, animations or other data.

In a second implementation of the invention the translation attribute is the size of the hour symbol; the size of the hour symbol in the display area indicates the proportion of minutes of the hour of the time to display which have past. FIGS. 2A-2D are time-lapsed illustrations of 4 times that demonstrate a second implementation of the invention. In these figures the origin is the maximum size the hour symbol can be while still fitting inside the display area; and the destination is the minimum size the hour symbol can be while still being readable. These figures show the hour symbol and the state of the background of the display area changed in conjunction with the proportional adjustment of the number of minutes of the time to display. In this example the first state, representing the remaining minutes, is white and the second state, representing the past minutes, is black. The times indicated by the size of the hour symbol in these figures are 2A twelve o'clock (12:00), 2B five minutes past twelve (12:05), 2C twelve thirty (12:30), 2D twelve forty-five (12:45).

In a third implementation of the invention the translation attribute is the combination of the position and size of the hour symbol. FIGS. 3A-3D are time-lapsed illustrations of 4 times that demonstrate a potential implementation of the position and size of the hour symbol in the display area indicating the proportion of minutes of the hour of the time to display which have past. These figures show the hour symbol and the state of the background of the display area changed in conjunction with the proportional adjustment of the number of minutes of the time to display. In this example the first state, representing the remaining minutes, is white and the second state, representing the past minutes, is black. The times indicated by the position and size of the hour symbol in these figures are 3A twelve o'clock (12:00), 3B five minutes past twelve (12:05), 3C twelve thirty (12:30), 3D twelve forty-five (12:45).

In a fourth implementation of the invention the translation attribute is the rotation of the hour symbol. FIGS. 4A-4D are time-lapsed illustrations of 4 times that demonstrate a potential implementation of the rotation of the hour symbol in the display area indicating the proportion of minutes of the hour of the time to display which have past. In this implementation the origin is the hour symbol pointing to the top of the display area. The destination is a clockwise 360 degree rotation. In this implementation, when using Arabic numerals as the hour symbol the hours 6 and 9 have a preferably distinguishing element, such as a mark for the top of the 6 and 9. In these examples the display area shape is a rectangle and there is a small black circle 31 to further distinguish the top of the hour symbol. The times indicated in these figures are 4A four o'clock (4:00), 4B five minutes past four (4:05), 4C four thirty (4:30), 4D four forty-five (4:45).

Embodiments may have minute increment markers that can be toggled on or off at the users discretion. Markers can be arranged at various intervals with a plurality of possible symbols. When the display area is divided into first and second state the intersection of these two states may be on or near the current minute of the minute increment markers. The boundary between the first and second state may be a coarse divider between the two states or may be shaped to further indicate the current minute. Some exemplary embodiments are illustrated in FIGS. 5A-7C. These figures are additional examples of a third implementation as described above with the markers on.

The translation attribute can include a minute marker pointer symbol to further indicated the current minute of the minute increment markers. The minute marker pointer symbol is adjusted in conjunction with the proportional adjustment. The minute marker pointer symbol may point to the current minute of the minute increment markers regardless of whether the increment markers are drawn in the display area. Some possible minute marker pointer symbols are illustrated in the figures. FIGS. 3B-3C, 4B, 6B, 8 demonstrates the translation attribute having a minute marker pointer symbol 31 to indicated the current minute of the minute increment markers.

Figure 5B:
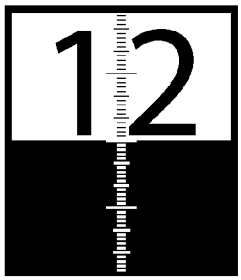

FIGS. 5A-5B demonstrate a possible implementation of minute increment markers for sixty minutes. In these examples the markers are short lines, with five minute and fifteen minute marker lines longer. The minute increment markers can be aligned anywhere on the display area; in 5A the markers are at the left, in 5B the markers are in the center. The time in both is twelve thirty (12:30).

Figure 6A:
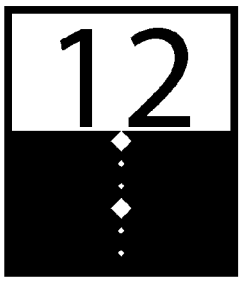
FIGS. 6A-6B show implementations of minute increment markers at an interval of 1 marker for every 5 minutes.
Figure 6B:
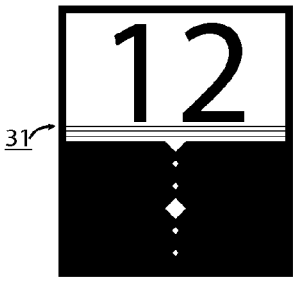
Figure 6C:
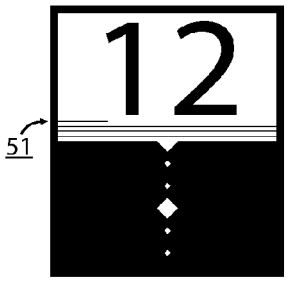
FIG. 6C shows implementations of minute increment markers with a seconds symbol.

FIGS. 6A-6C demonstrate a possible implementation of minute increment markers at five minute intervals. In these examples there are 5 minute increment markers that are shown for each 5 minutes of the hour that have past the minute of the time to display. The five minute increment markers are small squares, and the fifteen minute marker are bigger squares. The time in 6A is twelve thirty-two (12:32). FIG. 6B has the addition of 1 minute marker lines that are only shown for the each of the most recent 4 minutes between the 5 minute increment markers. At every 5 minutes the 1 minute increment markers are cleared and the area is filled up to the current minute. The time at 6B is twelve thirty-three (12:33).

Figure 7A:
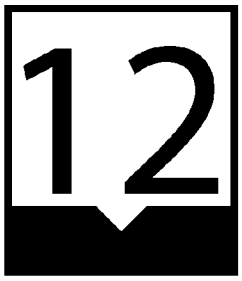
FIGS. 7A-7C show implementations of minute increment markers at an interval of 1 marker for every 15 minutes.
Figure 7B:
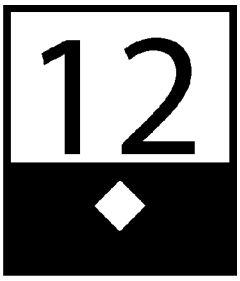
Figure 7C:
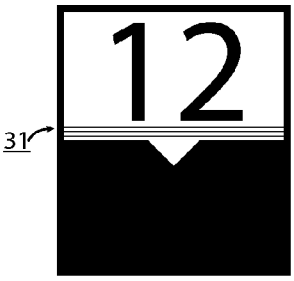
Figure 8:
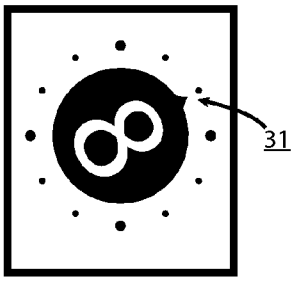
FIG. 8 shows an implementation of minute increment markers at an interval of 1 marker for every 5 minutes with a minute marker pointer symbol.

FIGS. 7A-7C demonstrate a possible implementation of minute increment markers at fifteen minute intervals. In this example the fifteen minute increment markers only appear at the last fifteen minute increment that has past: 15, 30 or 45 minutes past the hour. The size of the marker is relative to 10 minutes proportional to the display area, and it is positioned on screen so the center of the marker is positioned at the 15 minute increment, one side is exactly 5 minutes before that and the other side is exactly 5 minutes after. The time in 5A is twelve fifteen (12:15). The time in 7B is twelve twenty five (12:25). The time at 7C is twelve thirty-three (12:33). 7C includes extra markers for the three minutes past the 15 minute marker.

Another implementation with rotation of the hour symbol being the translation attribute is illustrated in FIG. 8. In this example there are 5 minute increment markers that are arranged in a circle around the hour symbol at 5 minutes intervals. The 15 minute increments are represented by small circles and the interstitial 5 minute increments are represented by smaller circles. The times indicated in FIG. 8 is ten minutes past eight (8:10).

Embodiment may have a seconds symbol that can be toggled on or off at the users discretion. The seconds indicator is preferably updated continuously with a seconds symbol that represents the exact second. The seconds symbol may be an abstract symbol that moves along the minute increment markers, a numeric symbol that moves along the minute increment markers, or a symbol at a fixed position which is a numeric symbol or proportional animation.

At FIG. 5A 51 a seconds symbol moves along the minute increment markers from an origin position at the bottom of the display area to the destination position at the top of the display area proportionally to the number of seconds of the time to display which have past. In FIG. 5A the time is twelve thirty and twenty seconds (12:30:20). At FIG. 6C 51 the seconds symbol is a line which elongates horizontally across the display area proportionally to the number of seconds of the time to display which have past. In 6C the time is twelve thirty three and fifteen seconds (12:33:15).

While shown and described herein as a method and system for graphical representation of time, it is understood that aspects of the invention further provide various alternative embodiments. For example, in one embodiment, the invention provides a computer program fixed in at least one computer-readable medium, which when executed, enables a computing device to provide a graphical representation of time. To this extent, the computer-readable medium includes program code which implements some or all of a process described herein. It is understood that the term "computer-readable medium" comprises one or more of any type of tangible medium of expression, now known or later developed, from which a copy of the program code can be perceived, reproduced, or otherwise communicated by a computing device. For example, the computer-readable medium can comprise: one or more portable storage articles of manufacture; one or more memory/storage components of a computing device; and/or the like.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. A method for graphical representation of time on a device having one or more processors, a non-transitory storage medium, and a means to control one or more display screens, the method comprising:

having a plurality of hour symbols corresponding to the plurality of hours in a day, wherein each hour symbol has a shape which denotes a number;

determining a time to display;

determining the origin and destination in a display area of the one or more display screens;

selecting the hour symbol based on the hour of the time to display;

calculating a proportional adjustment based on the number of minutes in the time to display, and the origin and destination;

changing at least one of the size and rotation of the hour symbol by the proportional adjustment; and drawing the proportionally adjusted hour symbol in the display area.

2. The method of claim 1, further comprising:

changing the position of the hour symbol by the proportional adjustment.

3. The method of claim 1, further comprising:

drawing the display area divided into a first state to represent the remaining minutes of the hour, and a second state to represent the past minutes of the hour, with distinguishing the first state from the second state with contrasting colors, patterns, images, animation or other data, and with translating the boundary between the first and second state in conjunction with the proportional adjustment of the number of minutes of the time to display; and drawing the proportionally adjusted hour symbol overlaying the first and second state in the display area.

4. The method of claim 1, further comprising:

having minute increment markers;

having a means for selectively drawing the minute increment markers in the display area;

having a minute marker pointer symbol;

changing at least one of the size and rotation and position of the minute marker pointer symbol by the proportional adjustment; and drawing the proportionally adjusted minute marker pointer symbol in the display area.

5. The method of claim 4, wherein:

the minute marker pointer symbol has a plurality of minute symbols; and selecting the current minute symbol based on the minute of the time to display.

6. The method of claim 1, further comprising:

having seconds increment markers;

having a means for selectively drawing the seconds increment markers in the display area;

having a seconds symbol;

changing at least one of the size and rotation and position of the seconds symbol by a proportional adjustment based on the number of seconds in the time to display and an origin and destination; and drawing the proportionally adjusted seconds symbol in the display area.

7. The method of claim 6, wherein:

the seconds symbol has a plurality of seconds symbols; and selecting the current seconds symbol based on the seconds of the time to display.

8. A device, comprising:

one or more display screens;

one or more processors;

a non-transitory storage medium storing instructions operable to cause the one or more processors to perform operations causing the one or more display screens to continuously display;

a proportionally adjusted hour symbol at or between an origin and destination, wherein the hour symbol has a shape which denotes a number;

the hour symbol is selected from a plurality of hour symbols corresponding to the plurality of hours in a day;

the hour symbol selection is based on the hour of a time to display;

the hour symbol is proportionally adjusted by at least one of size and rotation; and the proportional adjustment is based on the number of minutes in the time to display and the origin and destination.

9. The device of claim 8, further comprising:

changing the position of the hour symbol by the proportional adjustment.

10. The device of claim 8, further comprising:

drawing the display area divided into a first state to represent the remaining minutes of the hour, and a second state to represent the past minutes of the hour, with distinguishing the first state from the second state with contrasting colors, patterns, images, animation or other data, and with translating the boundary between the first and second state in conjunction with the proportional adjustment of the number of minutes of the time to display; and drawing the proportionally adjusted hour symbol overlaying the first and second state in the display area.

11. The device of claim 8, further comprising:

having minute increment markers;

having a means for selectively drawing the minute increment markers in the display area;

having a minute marker pointer symbol;

changing at least one of the size and rotation and position of the minute marker pointer symbol by the proportional adjustment; and drawing the proportionally adjusted minute marker pointer symbol in the display area.

12. The device of claim 11, wherein:

the minute marker pointer symbol has a plurality of minute symbols; and selecting the current minute symbol based on the minute of the time to display.

13. The device of claim 8, further comprising:

having seconds increment markers;

having a means for selectively drawing the seconds increment markers in the display area;

having a seconds symbol;

changing at least one of the size and rotation and position of the seconds symbol by a proportional adjustment based on the number of seconds in the time to display and an origin and destination; and drawing the proportionally adjusted seconds symbols in the display area.

14. The device of claim 13, wherein:

the seconds symbol has a plurality of seconds symbols; and selecting the current seconds symbol based on the seconds of the time to display.

15. The device of claim 8, wherein:

the device is a clock.

16. The device of claim 8, wherein:

the device is a wristwatch.

17. The device of claim 8, wherein:

the device is a timer.

18. A computer program comprising program code embodied in at least one non-transitory storage medium, which when executed causes one or more processors to perform operations comprising:

having a plurality of hour symbols corresponding to the plurality of hours in a day, wherein each hour symbol has a shape which denotes a number;

determining a time to display;

determining the origin and destination in a display area of one or more display screens;

selecting the hour symbol based on the hour of the time to display;

calculating a proportional adjustment based on the number of minutes in the time to display, and the origin and destination;

changing at least one of the size and rotation of the hour symbol by the proportional adjustment; and drawing the proportionally adjusted hour symbol in the display area.

19. The computer program of claim 18, further comprising:

changing the position of the hour symbol by the proportional adjustment.

20. The computer program of claim 18, further comprising:

drawing the display area divided into a first state to represent the remaining minutes of the hour, and a second state to represent the past minutes of the hour, with distinguishing the first state from the second state with contrasting colors, patterns, images, animation or other data, and with translating the boundary between the first and second state in conjunction with the proportional adjustment of the number of minutes of the time to display; and drawing the proportionally adjusted hour symbol overlaying the first and second state in the display area.

21. The computer program of claim 18, further comprising:

having minute increment markers;

having a means for selectively drawing the minute increment markers in the display area;

having a minute marker pointer symbol;

changing at least one of the size and rotation and position of the minute marker pointer symbol by the proportional adjustment; and drawing the proportionally adjusted minute marker pointer symbol in the display area.

22. The computer program of claim 21, wherein:

the minute marker pointer symbol has a plurality of minute symbols; and selecting the current minute symbol based on the minute of the time to display.

23. The computer program of claim 18, further comprising:

having seconds increment markers;

having a means for selectively drawing the seconds increment markers in the display area;

having a seconds symbol;

changing at least one of the size and rotation and position of the seconds symbol by a proportional adjustment based on the number of seconds in the time to display and an origin and destination; and drawing the proportionally adjusted seconds symbol in the display area.

24. The computer program of claim 23, wherein:

the seconds symbol has a plurality of seconds symbols; and selecting the current seconds symbol based on the seconds of the time to display.

* * * * *